United States Patent [19]

Smith et al.

[11] Patent Number: 4,894,493

[45] Date of Patent: Jan. 16, 1990

[54] MEMBRANE TOUCH CONTROL PANEL ASSEMBLY FOR AN APPLIANCE WITH A GLASS CONTROL PANEL

[75] Inventors: John M. Smith; Howard R. Bowles, both of Louisville, Ky.

[73] Assignee: General Electric Company, Louisville, Ky.

[21] Appl. No.: 267,507

[22] Filed: Nov. 4, 1988

[51] Int. Cl.[4] ..... H01H 13/70

[52] U.S. Cl. ..... 200/5 A; 200/600

[58] Field of Search ..... 200/5 R, 5 A, 308, 310, 200/314, 317, 512, 517, 600; 361/398, 358, 283; 341/33, 22, 24; 84/343; 400/479.1, 479.2; 219/10.55 R, 10.55 B, 10.55 E

[56] References Cited

U.S. PATENT DOCUMENTS

| | | | |
|---|---|---|---|
| 3,811,025 | 5/1974 | Bach | 200/317 |
| 4,056,699 | 11/1977 | Jordan | 200/5 A |
| 4,060,703 | 11/1977 | Everett, Jr. | 200/317 X |
| 4,071,718 | 1/1978 | Harden | 200/5 A |
| 4,128,744 | 12/1978 | Seeger | 200/512 X |
| 4,145,584 | 3/1979 | Otterlei | 200/5 A |
| 4,149,217 | 4/1979 | Tucker | 219/10.77 X |
| 4,163,138 | 7/1979 | Harden | 200/310 |
| 4,220,815 | 9/1980 | Gibson et al. | 200/512 X |
| 4,228,330 | 10/1980 | Larson | 200/5 A |
| 4,264,797 | 4/1981 | Parkinson | 200/512 |
| 4,320,272 | 3/1982 | Larson | 200/317 |
| 4,356,755 | 11/1982 | Davis et al. | 84/343 |
| 4,362,954 | 12/1982 | Cotton | 307/142 |
| 4,377,049 | 3/1983 | Simon et al. | 341/33 |
| 4,526,332 | 7/1985 | Bales | 248/27.1 |

*Primary Examiner*—J. R. Scott

*Attorney, Agent, or Firm*—H. Neil Houser; Radford M. Reams

[57] ABSTRACT

An appliance with a glass control panel is provided with a membrane touch control panel assembly which simulates the appearance of a glass capacitive touch panel, and which can tolerate relatively harsh temperature environments such as on the backsplash of a range.

8 Claims, 3 Drawing Sheets

FIG. 1
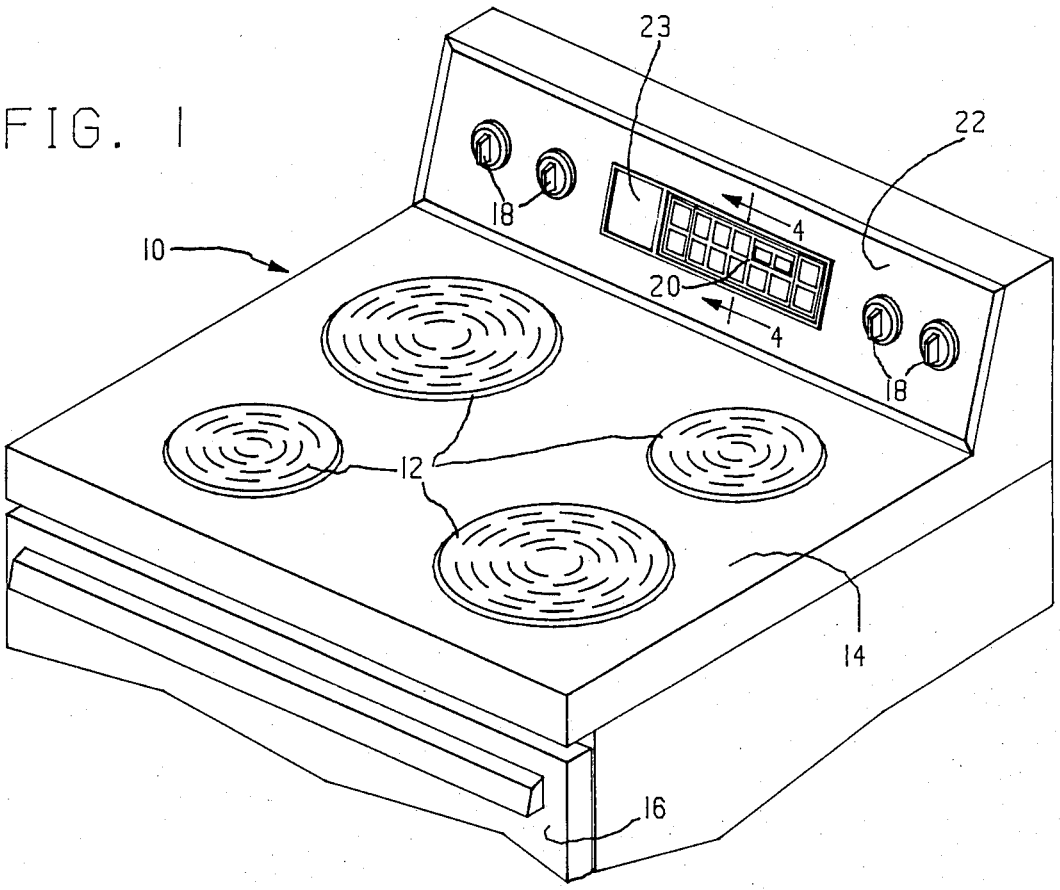
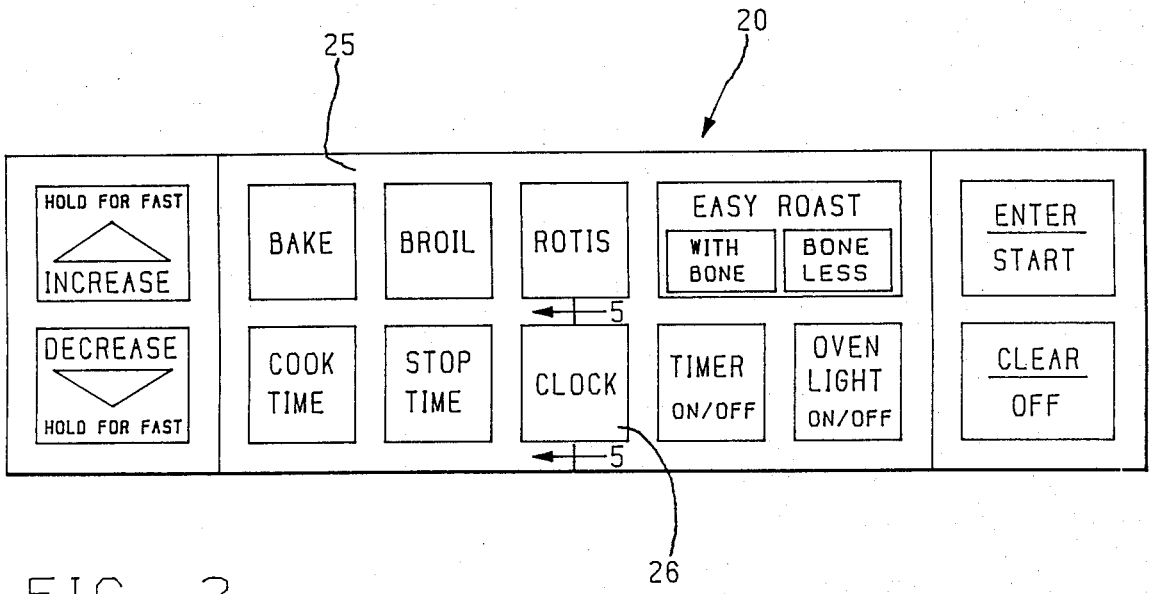
FIG. 2

MEMBRANE TOUCH CONTROL PANEL ASSEMBLY FOR AN APPLIANCE WITH A GLASS CONTROL PANEL

BACKGROUND OF THE INVENTION

This invention relates to a membrane touch switch control panel assembly for appliances with glass control panels.

Use of glass control panels for appliances such as ranges and wall ovens is well known. Such appliances typically have electromechanical controls with user manipulated control knobs projecting through holes in the glass. Such structural arrangements are inconvenient to clean and also allow soils to enter the area behind the control panel leading to an unsightly appearance and possibly contaminating the control circuitry.

In some instances capacitive touch panel arrays have been used in lieu of mechanical knobs and switches, enhancing appearance and cleanability. Such arrays can be fabricated directly on the glass panel which serves as the dielectric substrate, thereby providing a smooth surface with no openings to collect food soils and a modern high tech appearance. Also such arrays can withstand the relatively high temperature environment to which range and oven controls are exposed. Capacitive touch switch arrays have been found to provide satisfactory performance and pleasing appearance. However, capacitive touch panels while mechanically simple are electrically relatively complex and have a relatively high system cost. Consequently, such controls generally are provided only on expensive appliances positioned at the high end of the model line.

Membrane touch switch arrays, which have substantially less system cost than capacitive touch pad arrays, are used in refrigerator, dishwasher, microwave ovens, and laundry appliances which provide a less harsh temperature environment, since materials conventionally used in membrane touch switch arrays do not tolerate high temperatures well.

Therefore, a touch control panel for appliances which has the cost advantages of membrane switch panels and the appearance and temperature tolerance advantage of capacitive touch control arrays would be highly desirable.

It is therefore a primary object of the present invention to provide a membrane touch switch control panel assembly for an appliance which provide the appearance and cleanability and temperature tolerance benefits of a capacitive touch panel array.

SUMMARY OF THE INVENTION

In accordance with the present invention an appliance with a glass control panel is provided with a membrane touch switch control panel assembly which provides the smooth appearance, easy cleanability of a glass capacitive touch panel, and a higher temperature tolerance than that of conventional membrane switch array.

A laminated membrane switch array is disposed on the outer surface of the glass control panel. The glass panel has a hole formed therein to allow the ribbon cable for the membrane switch array to pass through the panel to control circuitry positioned behind the panel. A bezel circumscribes the switch array with an inner edge which overlappingly engages the array at its periphery to hold the array in position on the panel with its face exposed to permit user actuation of the membrane switches. A gasket may be sandwiched between the bezel and the glass panel to provide a seal therebetween. The outer graphics layer of the membrane switch array is formed of a flexible, resilient temperature resistant material, preferably a hard coat polycarbonate material, capable of withstanding temperature in excess of 220° F.

BRIEF DESCRIPTION OF THE DRAWINGS

While the novel features of the invention are set forth with particularity in the appended claims, the invention, both as to organization and content, will be better understood and appreciated along with other objects and features thereof, from the following description taken in conjunction with the drawings, in which:

FIG. 1 is a perspective view of the upper portion of a free-standing range illustratively embodying the membrane touch control panel assembly of the present invention;

FIG. 2 is an enlarged plan view of the touch panel portion of the control panel of FIG. 1;

DETAILED DESCRIPTION

Figure 3:
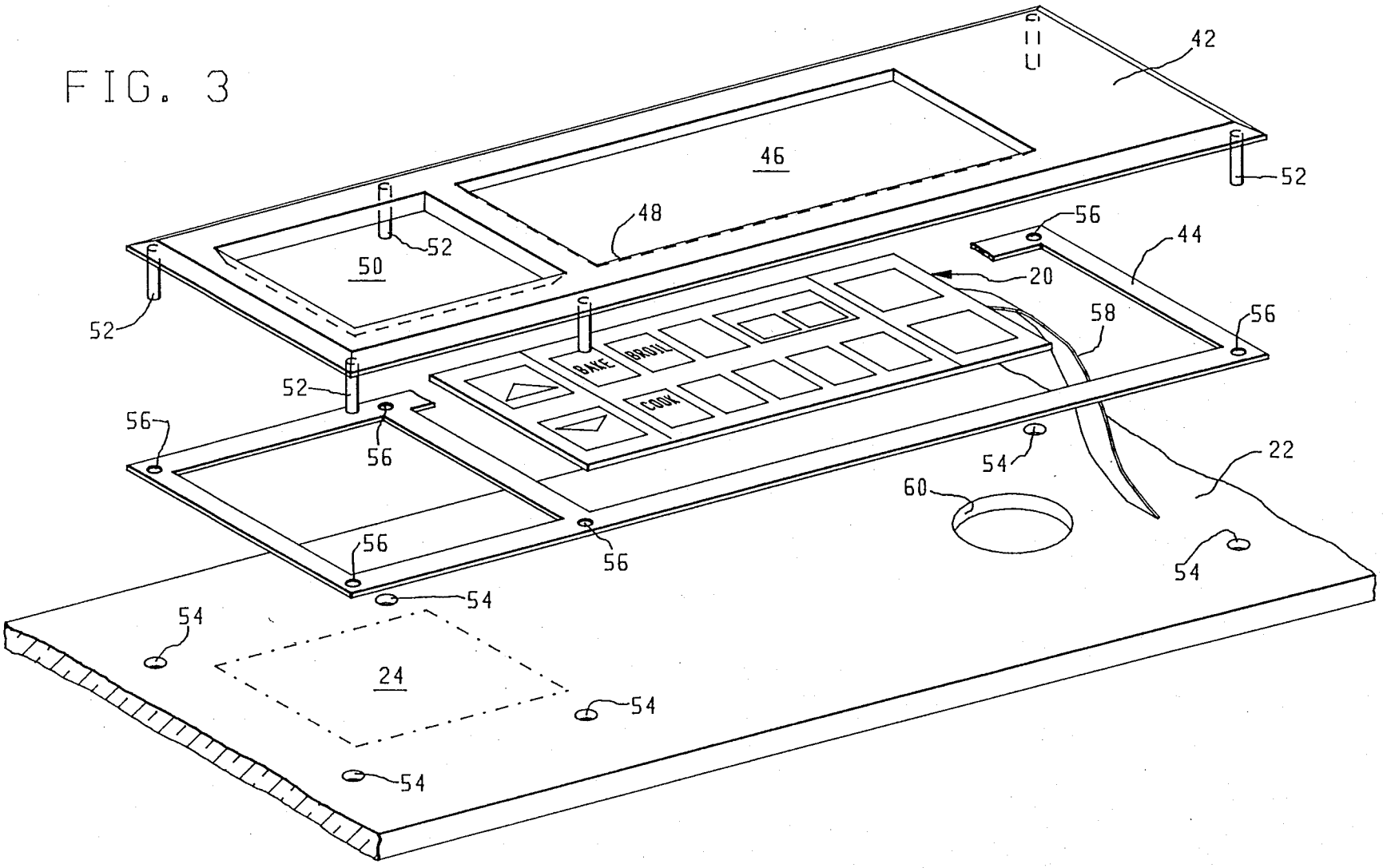
FIG. 3 is an exploded perspective view of the touch panel assembly embodied in the range of FIG. 1.

Referrig now to the drawings and in particular to FIGS. 1-3, there is shown a free-standing range 10, with four conventional surface units 12, supported from cooktop surface 14, and an oven enclosed by oven door 16. Control knobs 18 for the surface units and oven controls comprising a touch switch array 20 are supported from the backsplash comprising glass panel 22. In order to minimize the exposure of the touch switch array to radiant energy from the back two surface units, the switch array is centered horizontally on panel 22 relative to the surface units. Viewing area 23 on panel 22 exposes an electronic display disposed behind the panel area shown in phantom at 24 in FIG. 3. This display may include a real time clock, an oven timer, and oven operating mode indicators and prompts for operation of the oven controls. As best seen in FIG. 2, touch switch array 20 includes a graphical overlay 25 with indicia identifying the location and function of the various touch switches.

Figure 5:
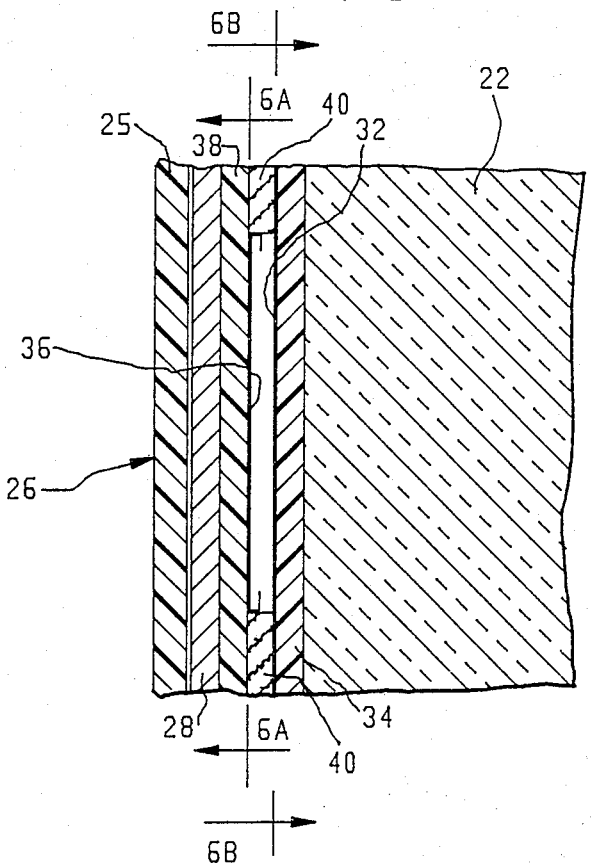
FIG. 5 is an exaggerated sectional view of a switch portion of the laminated membrane switch array of FIG. 4 taken along line 5—5 of FIG. 2.

As best seen in FIG. 5, membrane touch switch array 20 is a laminated touch switch array which, with the exception of the graphics layer 25 is of generally conventional construction. FIG. 5 is greatly expanded sectional view of that portion of array 20 comprising touch switch 26 which is representative of the other touch switches in the membrane touch switch array 20. The thicknesses are exaggerated for clarity.

Because of the harsh temperature environment due to the proximity of the control panel to the surface units, the graphics overlay for membrane switch array requires a flexible, resilient material capable of withstanding the relatively high temperature environment at the backsplash proximate the rear surface units. Temperature in this area can be on the order of 220° F. or higher. Thus, suitable materials must be albe to withstand such temperatures. Materials conventionally used with membrane touch panel arrays cannot tolerate such temperatures. One material found to have characteristics which meet the flexibility, resiliency and temperature requirements for range application is the hard coat polycarbonate material available from General Electric Company under the registered trademark Lexan. In the illustrative embodiment graphics overlay layer 25 is formed of Lexan hard coat polycarbonate material with thickness on the order of .015 inches.

Figure 6A:
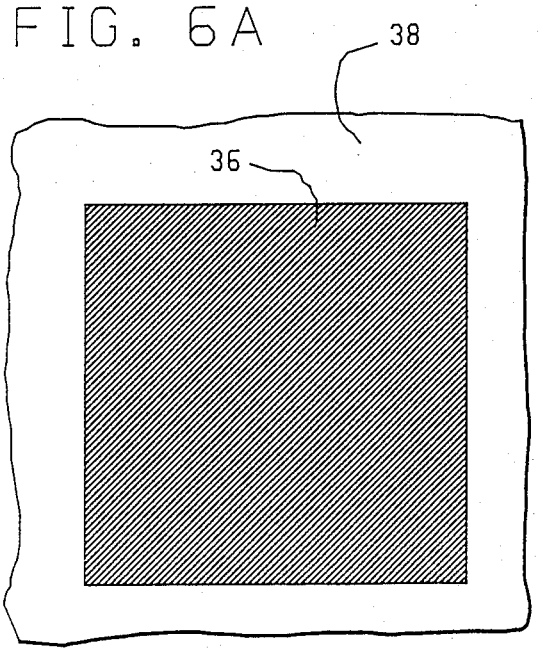
FIGS. 6A and 6B show details of the shorting electrode and switching electrodes for the segment of the switch array illustrated in FIG. 5.
Figure 6B:
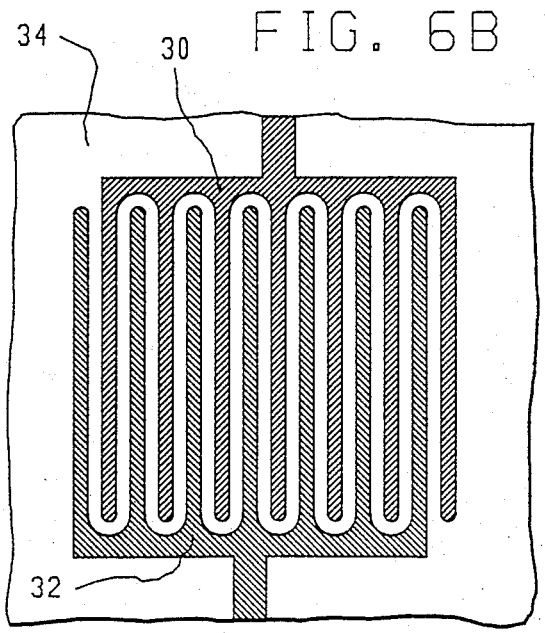

The remaining structure of the membrane switch array is generally conventional in nature and will be only briefly described. A layer of aluminum foil 28 on the order of 0.35 mils in thickness serves as an electrostatic shield for the switch array. As best seen in FIGS. 6A and 6B, switch 26 comprises a pair of printed circuit electrodes or contacts 30 and 32 formed on switch layer 34, and a shorting contact or electrode 36 formed on switch layer 38. Switch layers 34 and 38 are formed of polyester material. The conductive patterns for the switch contacts are deposited on the circuit boards using conventional printed circuit techniques. Each of contacts 30 and 32 have a plurality of fingers interleaved with and spaced apart from the fingers from the other contact. Shorting contact 36 is disposed in juxtaposition with contacts 30 and 32. Insulating spacers 40 between circuit boards 34 and 38 establish a gap between contact 36 and contacts 30 and 32. Switch 26 is actuated by pressing the switch area above contact 36, which urges contact 36 into electrical contact across contacts 30 and 32 thereby closing the switch.

Figure 4:
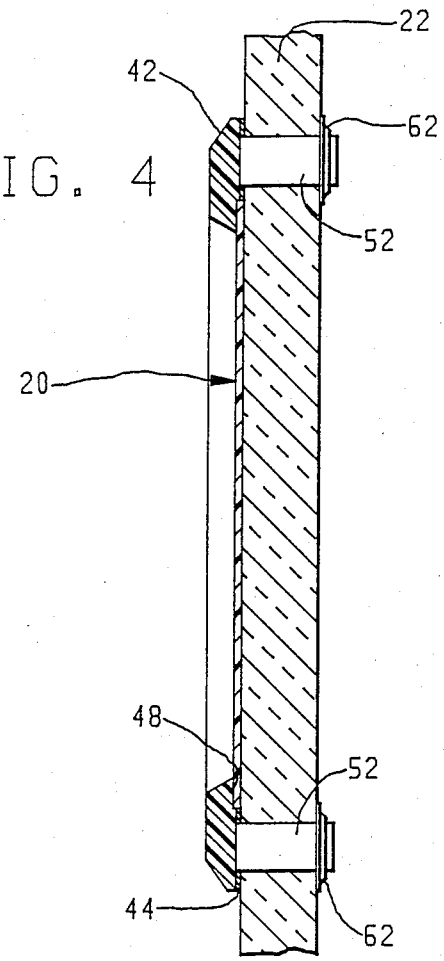
FIG. 4 is a sectional view of the control panel for the range in FIG. 1 taken along lines 4—4.

As best seen in FIGS. 3–5, the touch panel assembly comprises membrane switch array 20 and bezel 42. Optional gasket 44 provides a seal between bezel 42 and panel 22; however, it has been found that bezel 42 can be sufficiently secured to panel 22 to provde an adequate seal therebetween. Thus, gasket 44 is not necessary for satisfactory performance. Membrane switch array 20 is secured on the outer surface of glass panel 22 by a plastic bezel 42 which circumscribes membrane switch array 26. Bezel 42 includes a rectangular opening 46 to accommodate switch array 20. A flange 48 formed along the inner edge of bezel 42 surrounding rectangular opening 46, overlappingly engages the peripheral edges of switch array 20 to retain array 20 in position on control panel 22. A second opening 50 in bezel 42 exposes viewing area 23 for the digital display (not shown) mounted behind the glass panel and visible therethrough.

A plurality of mounting studs 52 project from bezel 42. A plurality of small holes 54 are formed in glass panel 22 for receiving studs 52 to locate bezel 42 on panel 22. Optional gasket 44 is shown sandwiched between bezel 42 and glass panel 22 to provide a seal therebetween. Openings 56 in gasket 44 align with openings 54 in panel 22 to accommodate mounting studs 52.

Membrane switch panel array 20 includes a ribbon cable 58 which carries conductors for connecting the touch panel array to control circuitry (not shown) disposed behind panel 22. Glass panel 22 has an opening 60 to accommodate ribbon cable 58 which passes therethrough to the control circuitry behind the panel.

As best seen in FIG. 4, mounting studs 52 project through the glass panel. Fastening means such as push-on lock nuts 62 attached to the ends of studs 52 behind panel 22 snugly secure bezel 42 against gasket 44 and the periphery of membrane switch array 20.

When fully assembled, bezel 42 appears as simply a trim piece on the glass surface to set off the touch switches, the overall effect being to simulate the appearance of a capacitive touch panel.

While in accordance with the Patent Statutes a specific embodiment of the present invention has been illustrated and described herein, it is realized that numerous modifications and changes will occur to those skilled in the art. For example, the touch panel assembly is described for use in a free-standing range. However, the touch panel assembly can be readily employed with other appliances equipped with glass control panels such as, for example, built-in wall ovens. It is therefore to be understood that the appended claims are intended to cover all modifications and changes as fall within the true spirit and scope of the invention.

What is claimed is:

1. In a cooking appliance having a plurality of surface units and a glass control panel disposed proximate the surface units a membrane touch switch control panel assembly comprising:

a laminated membrane switch array disposed on the outer surface of the glass control panel having a ribbon cable for connecting said switch array to control the circuitry disposed behind the glass control panel, the glass control panel having a hole formed therein to allow said ribbon cable to pass therethrough;

a bezel which circumscribes said switch array having an inner edge which overlappingly engages said switch array at the periphery thereof;

means for securing said bezel to the outer surface of the glass control panel, said switch array being sandwiched between said inner edge of said bezel and outer face of the glass control panel;

whereby said membrane touch switch control panel assembly simulates the appearance of a glass capacitive touch panel.

2. The membrane touch switch control panel assembly of claim 1 wherein the glass control panel has formed therein a plurality of holes and wherein said securing means comprises mounting studs projecting from the inner surface of said bezel for receiving said studs thereby locating said switch array on the glass control panel.

3. The membrane touch switch control panel assembly of claim 1 wherein said switch array includes an outer graphics layer comprising a flexible resilient material capable of withstanding temperatures in excess of 220° F.

4. The membrane touch switch control panel assembly of claim 3 wherein said outer graphics layer is formed of hard coat polycarbonate material.

5. A membrane touch switch control panel assembly for a cooking appliance having a plurality of surface units and a glass control panel disposed proximate at least one of the surface units, said assembly comprising:

a laminated membrane switch array disposed on the outer surface of the glass control panel;

said switch array including an outer appearance graphics layer formed of a flexible resilient material capable of withstanding temperatures in excess of 220° F.;

mounting means circumscribing said switch array for sealingly securing said switch array at the edges thereof to the glass control panel;

said outer appearance graphics layer and said mounting means together simulating the appearance of a glass capacitive touch panel.

6. The membrane touch switch control panel assembly of claim 5 wherein said mounting means comprises a bezel which circumscribes said switch array having an inner edge which overlappingly engages said switch array at the periphery thereof, said bezel having mounting studs projecting from the inner surface thereof, the glass control panel having a plurality of holes formed therein for receiving said mounting studs to locate said bezel and said switch array and secure said bezel to the glass control panel.

7. The membrane touch switch control panel assembly of claim 6 wherein said switch array includes a ribbon cable for conecting said switch array to control circuitry disposed remote from said switch array, and wherein the glass control panel has formed therein a hole for permitting said cable to pass therethrough.

8. The membrane touch switch control panel assembly of claim 7, wherein said outer appearance graphics layer is formed of hard coat polycarbonate material.

* * * * *